United States Patent [19]

Larson

[11] 4,191,910

[45] Mar. 4, 1980

[54] STARTING ARRANGEMENT FOR HIGH PRESSURE DISCHARGE SODIUM LAMP

[75] Inventor: Daniel A. Larson, Cedar Grove, N.J.

[73] Assignee: Westinghouse Electric Corp., Pittsburgh, Pa.

[21] Appl. No.: 948,131

[22] Filed: Oct. 3, 1978

[51] Int. Cl.[2] ..... H01J 7/44

[52] U.S. Cl. ..... 315/51; 313/198; 313/218; 315/60; 315/73

[58] Field of Search ..... 313/198; 315/51, 53, 315/60, 73

[56] References Cited

U.S. PATENT DOCUMENTS

| | | | |
|---|---|---|---|
| 3,226,597 | 12/1965 | Green | 315/60 |
| 3,281,309 | 10/1966 | Ross | 313/221 X |
| 3,461,334 | 8/1969 | Knochel et al. | 313/198 |
| 3,469,729 | 9/1969 | Grekila et al. | 220/2.3 R |
| 3,480,823 | 11/1969 | Chen | 313/823 |
| 3,746,914 | 7/1973 | Olson et al. | 315/47 |
| 4,103,200 | 7/1978 | Bhalla | 313/221 |

FOREIGN PATENT DOCUMENTS

| | | |
|---|---|---|
| 2316857 | 10/1974 | Fed. Rep. of Germany . |
| 47-49382 | 12/1972 | Japan . |
| 49-102573 | 9/1974 | Japan . |

*Primary Examiner*—Alfred E. Smith
*Assistant Examiner*—Charles F. Roberts
*Attorney, Agent, or Firm*—W. D. Palmer

[57] ABSTRACT

High-pressure-discharge (HID) sodium lamp has a starting aid comprising a plug-like ceramic member extending through the longitudinal wall of the arc tube proximate one of the lamp electrodes. The plug-like ceramic member is fused to the alumina arc tube and is electrically conductive by virtue of having embedded therein a small percentage of finely divided refractory metal. At least during lamp starting, the plug-like ceramic starting aid is electrically connected through a resistor to the opposite lamp electrode and, as a result, on application of energizing potential, a glow discharge is established between the interior surface of the plug-like ceramic member and the proximate lamp electrode to ionize the atmosphere within the arc tube to facilitate lamp starting.

11 Claims, 6 Drawing Figures

STARTING ARRANGEMENT FOR HIGH PRESSURE DISCHARGE SODIUM LAMP

BACKGROUND OF THE INVENTION

This invention relates to high-intensity-discharge (HID) sodium lamps and, more particularly, to an improved starting arrangement for such lamps.

HID sodium lamps are relatively difficult to start and normally require the application of a very high voltage pulse across the lamp electrodes. Other types of HID lamps incorporate a starting electrode sealed through an end of the arc tube and which is closely spaced to one of the main electrodes. In the case of HID sodium lamps, however, the space limitations normally preclude such a starting electrode and if metallic end caps are used to seal off the ends of the tubular arc tube, which is normally fabricated of alumina, it is difficult to insulate the starting electrode from the proximate main electrode.

A starting electrode for an HID sodium lamp is disclosed in Japanese Pat. No. 47-49382 dated Dec. 12, 1972. As shown in FIG. 2 of this patent, the starting aid comprises a metallic, annular-shaped member which is sealed on both sides to two tubular-shaped envelope members to form the arc tube body.

In German published patent application No. 2,316,857 dated Oct. 3, 1974 is disclosed a starting electrode for HID sodium lamps wherein a metallic coating (5*a* in the figures) is formed on the face of a ceramic ring 5 which, in turn, is sealed to the main tubular ceramic body to form the arc tube.

U.S. Pat. No. 3,461,334 dated Aug. 12, 1969 to Knochel et al. discloses a starting electrode for an HID sodium lamp wherein an annular-shaped metallic member is sealed to two tubular-shaped ceramic members to form the composite arc tube with the sealed starting arrangement.

Japanese Preliminary Publication of Utility Model patent application 49-102573 dated Sep. 4, 1974 discloses a starting electrode which is sealed through the ceramic end cap portion of a ceramic arc tube.

Various sealing materials for sealing refractory metals to alumina are known and U.S. Pat. No. 3,469,729 dated Sep. 30, 1969 to Grekila et al. discloses a calcia-alumina-silica composition for sealing tantalum or niobium to alumina. In U.S. Pat. No. 3,480,823 dated Nov. 25, 1969 to Chen is disclosed a somewhat similar composition which incorporates from 2% to 5% by weight of niobium powder to improve the bonding strength of the seal.

The use of a thermal switch which is responsive to the heat generated by an operating lamp to remove a starting potential from a starting electrode for an HID metal-halide-type lamp is shown in U.S. Pat. No. 3,226,597 dated Dec. 28, 1965 to Green, and U.S. Pat. No. 3,746,941 dated July 17, 1973 to Olson et al. discloses an HID sodium lamp wherein a wire starting aid is coiled about the arc tube, and after the lamp is operating, bi-metal switches isolate the starting aid from other electrical elements of the lamp.

SUMMARY OF THE INVENTION

The basic lamp comprises a high-pressure-discharge sodium lamp comprising an elongated arc tube of predetermined dimensions and having longitudinal walls of predetermined thickness. The arc tube is sealed at the ends thereof and encloses a discharge-sustaining filling comprising sodium and inert ionizable starting gas. Electrodes are operatively positioned within the arc tube proximate the ends thereof and lead-in means extend through the sealed ends of the arc tube and connect to the electrodes. A light-transmitting protective outer envelope surrounds the arc tube and a frame positioned within the outer envelope supports the arc tube in predetermined position. An electrical adaptor means such as a screw-type base is affixed to the outer envelope for connection to a source of power and a pair of electrical connection means, one of which includes the supporting frame, serve to electrically connect the lamp electrodes to the screw-type base.

In accordance with the present invention, at least one small plug-like electrically conductive ceramic means of predetermined dimensions extends through the longitudinal wall of the arc tube proximate at least one of the lamp electrodes. The plug-like ceramic means comprises refractory-oxide-based ceramic matrix which is non-reactive with respect to high-temperature sodium vapor and which also possesses the predetermined thermal-physical-chemical properties required to form a high-temperature seal with alumina. The refractory-oxide-based ceramic matrix is fused to the surrounding alumina arc tube wall and has embedded therein a small predetermined amount of finely divided refractory metal which is inert with respect to the discharge-sustaining filling and which provides the plug-like ceramic member with a predetermined electrical conductivity. During starting of the lamp, the plug-like ceramic member electrically connects, exteriorly of the arc tube, to the lamp electrode which is positioned proximate the opposite end of the arc tube from the plug-like ceramic member. During starting of the lamp, the total electrical resistance between the interior surface of the plug-like ceramic member and the connected opposite lamp electrode permits the maintenance of a glow-type discharge within the arc tube between the interior surface of the plug-like ceramic member and the lamp electrode which is proximate thereto. This ionizes the atmosphere within the arc tube to facilitate lamp starting.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
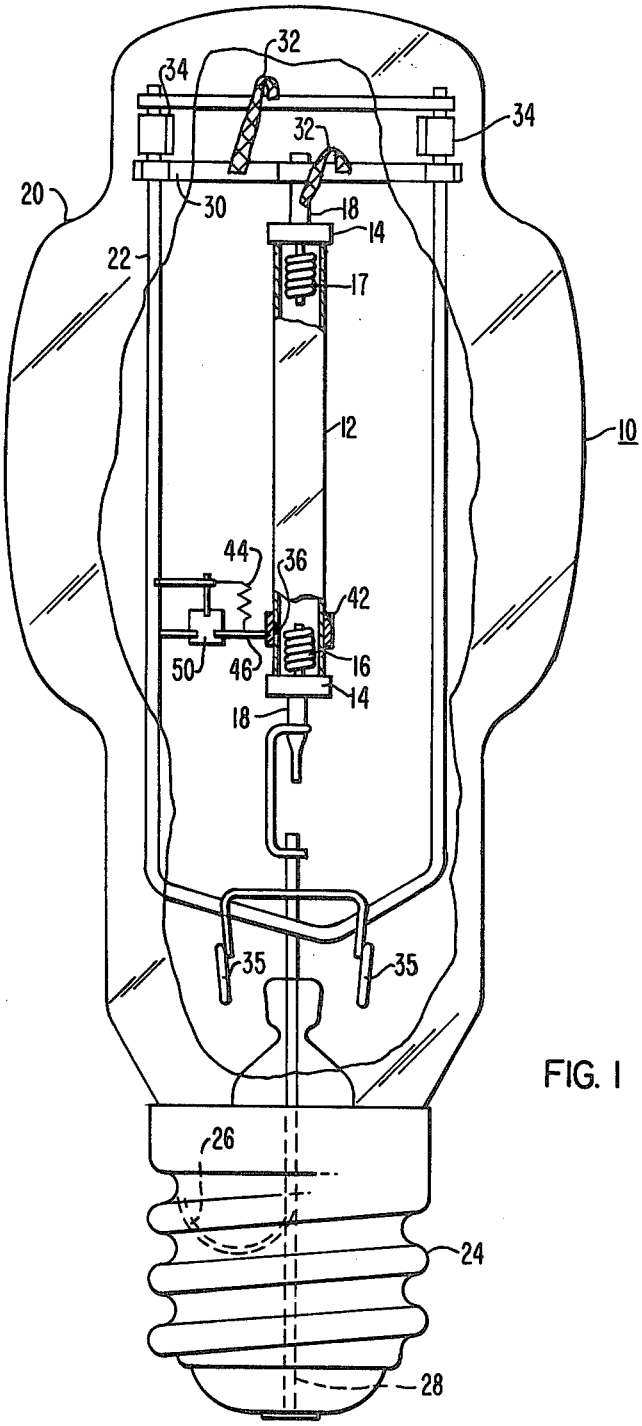
FIG. 1 is an elevational view, shown partly in section, of an HID sodium lamp which incorporates the present improved starting aid.

With specific reference to the form of the invention illustrated in the drawings, the lamp 10 as shown in FIG. 1 comprises an elongated alumina arc tube 12 of predetermined dimensions and having longitudinal walls of predetermined thickness. The elongated arc tube is sealed at the ends thereof by suitable end cap seals 14 fabricated of niobium and the arc tube encloses a discharge-sustaining filling comprising sodium or sodium plus mercury and inert ionizable starting gas such as xenon at a pressure of 20 torrs, for example. Electrodes 16, 17 are operatively positioned within the arc tube 12 proximate the ends thereof and lead-in conductors 18 extend through the sealed ends of the arc tube and connect to the electrodes 16, 17.

A light-transmitting protective outer envelope 20 surrounds the arc tube and a frame 22 is positioned within the outer envelope 20 and supports the arc tube 12 in predetermined position within the outer envelope 20. Electrical adaptor means such as a suitable screw-type base 24 is affixed to the outer envelope for connection to a source of power and a pair of electrical connection means 26, 28 serve to connect the base to the lead-ins 18. One of the electrical connectors 26 is connected to and includes the frame 22 for supplying power to one of the lamp electrodes 17.

To complete the general description, the upper support member 30 is movable on the lamp frame 22 to facilitate expansion and contraction of the arc tube 12 and connection to the arc tube electrode 17 is made through flexible conductors 32. The upper portion of the frame is supported and positioned within the dome of the outer envelope 20 by suitable leaf-spring supports 34. The outer envelope 20 normally encloses a hard vacuum which is obtained through use of suitable getter elements which are flashed from the getter supports 35.

Figure 2:
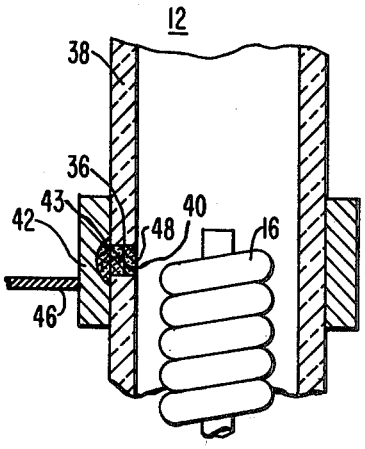
FIG. 2 is a fragmentary enlarged view, partly in section, of a portion of an arc tube showing the details of the plug-like ceramic starting aid and the electrical connections thereto.

In accordance with the present invention, and as shown in detail in the enlarged fragmentary view of FIG. 2, a small plug-like electrically conductive ceramic means 36 of predetermined dimensions extends through the longitudinal wall 38 of the arc tube 12 proximate one of the lamp electrodes 16. The plug-like ceramic member 36 comprises refractory-oxide-based ceramic matrix which is non-reactive with respective to high-temperature sodium vapor and which possesses the predetermined thermal-physical-chemical properties required to form a high-temperature seal with alumina. The refractory-oxide-based ceramic matrix is fused to the surrounding arc tube wall and there is embedded in the ceramic matrix a predetermined amount of finely divided refractory metal 40 which is inert with respect to the arc tube discharge-sustaining filling, in order to provide the plug-like ceramic member with a predetermined electrical conductivity. As a specific example, the arc tube 12 is formed of polycrystalline or single crystal alumina and the ceramic matrix is formed of 49.9% by weight calcia, 42.6% by weight alumina and 7.5% by weight silica in accordance with the forementioned U.S. Pat. No. 3,469,729. Embedded within the ceramic matrix is approximately 4% by weight of niobium powder which has a state of division such that it will pass a No. 325 mesh or sieve. Electrical contact is made to the plug 36 by means of a metallic sleeve 42 which encircles the arc tube and the sleeve 42 can be formed of niobium or other suitable refractory metal. In the preferred form, electrical contact is made between the plug 36 and the metallic sleeve 42 by means of a small amount of additional conducting plug-type material 43 which bonds both to the plug 36 and the inner surface of the sleeve 42. Alternatively the sleeve can be provided with a layer of silicon on the inner surface thereof, to increase the bond to the conducting ceramic material and such an enhanced bond is taught in U.S. Pat. No. 4,103,200 dated July 25, 1978 to R. S. Bhalla. Referring to FIG. 1, the sleeve is permanently connected via a suitable resistor 44 and connecting lead 46 to the frame 22 of the lamp.

During starting of the lamp, the plug-like ceramic member 36 is thus electrically connected, exteriorly of the arc tube 12, to that electrode 17 which is positioned proximate the opposite end of the arc tube 12 from the plug-like ceramic means or member 36. In this manner, the full starting potential is applied between the inner surface 48 of the plug 36 and the proximate lamp electrode 16. While the resistance of the plug 36 could be controlled by varying the amount of refractory metal embedded therein, it is preferred to limit the current which the plug can pass by incorporating the resistor 44 in series therewith so that during lamp starting, the total electrical resistance between the interior surface 48 of the plug-like member 36 and the connected opposite electrode 17 permits the maintenance of a glow-type discharge within the arc tube between the interior surface 48 of the plug and the proximate main electrode 16. This ionizes the atmosphere within the arc tube and facilitates starting of the lamp.

Figure 3:
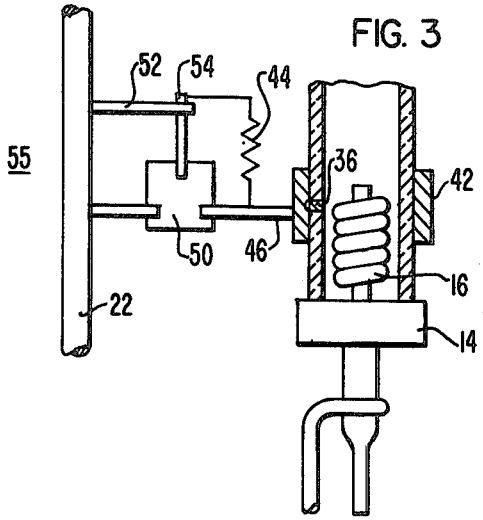
FIG. 3 is a fragmentary enlarged view, partly in section, showing the thermal switch arrangement for removing the starting aid from the circuit once the lamp is normally operating.

In the fragmentary enlarged view of FIG. 3 are shown the details for the circuit connections to the starting-aid ceramic plug 36. An insulating supporting member 50 is affixed to the proximate frame portion 22 and carries the switch contact members 52, 54 of a thermally actuated switch 55. This switch 55 is responsive to the heat generated by the normal operation of the arc tube to cause the bi-metal element 52 to move from contact with its cooperative contact 54 and thus remove the starting aid from the circuit once the lamp is operating. For some embodiments it is not necessary to remove the starting aid from the operating lamp circuit since the resistor 44, which typically has a value of 20,000 ohms, prevents any appreciable current flow through the ceramic plug member 36.

To complete the description of the lamp as shown in FIG. 1, the lamp is designed to operate with a wattage of 70 watts and the arc tube 12 has a spacing between electrodes of 25 mm, an inner diameter of 5.3 mm, and a wall thickness of 0.5 mm. The discharge-sustaining filling in the arc tube is sodium in amount of 30 mg or an amalgam of sodium and mercury in amount of 6.3 mg sodium and 23.7 mg mercury. The inert ionizable starting gas is xenon at a pressure of 20 torrs. Other starting gases at varying pressures can be substituted for the xenon, a typical example being the Penning mixture.

In fabricating the plug-like member 36, a small hole having a diameter of 0.4 mm can be bored in the arc tube wall, and the unfired ceramic matrix material plus the powdered niobium is inserted into the formed hole as a frit. The arc tube is then fired at a temperature of 1400° C. for three minutes in a vacuum or inert atmosphere. Alternatively, the hole can be formed with the arc tube in the "green" pressed state prior to firing same, in the case of polycrystalline alumina. With a 4% by weight addition of niobium powder, the fired ceramic plug-like member 36 has a typical room temperature resistance of approximately 1000 ohms.

As an alternative construction, the arc tube can be provided with ceramic-type end caps and such constructions are known. While the preferred material for the refractory-oxide-based ceramic matrix of which the ceramic plug 36 is formed is a mixture of calcia-alumina-silica, any other refractory-oxide-based ceramic matrix which is non-reactive with respect to high-temperature sodium vapor and which possesses the predetermined thermal-physical-chemical properties required to form a high-temperature seal with alumina may be substituted therefor. As an example, yttria-based materials which are known in the art as sealing materials for alumina arc tubes can be substituted for the preferred example as given. Another suitable sealing material is disclosed in U.S. Pat. No. 3,281,309 dated Oct. 25, 1966 to Ross. As a specific example, the ceramic matrix of the plug 36 comprises from about 44% to 55% by weight calcia, from about 40% to 50% by weight alumina, and from about 0.5 to 10% by weight silica. Also, any finely divided refractory metal which is inert with respect to the discharge-sustaining filling can be substituted for the preferred niobium. Examples of such other metals are tantalum or titanium, or mixtures thereof. The percentage of niobium added is not particularly critical and a 4% by weight addition has been found to be very suitable. Of course, the more niobium which is added, the lower the resistivity and vice versa.

Figure 5:
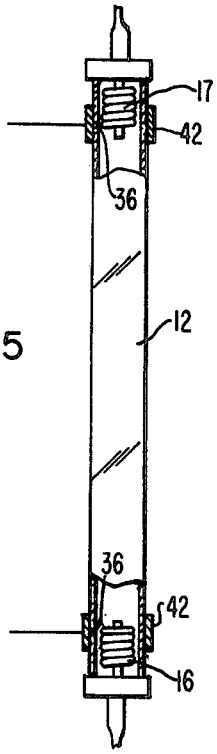
FIG. 5 is an enlarged elevational view of an arc tube provided with a starting aid embodiment generally as shown in FIG. 4.
Figure 4:
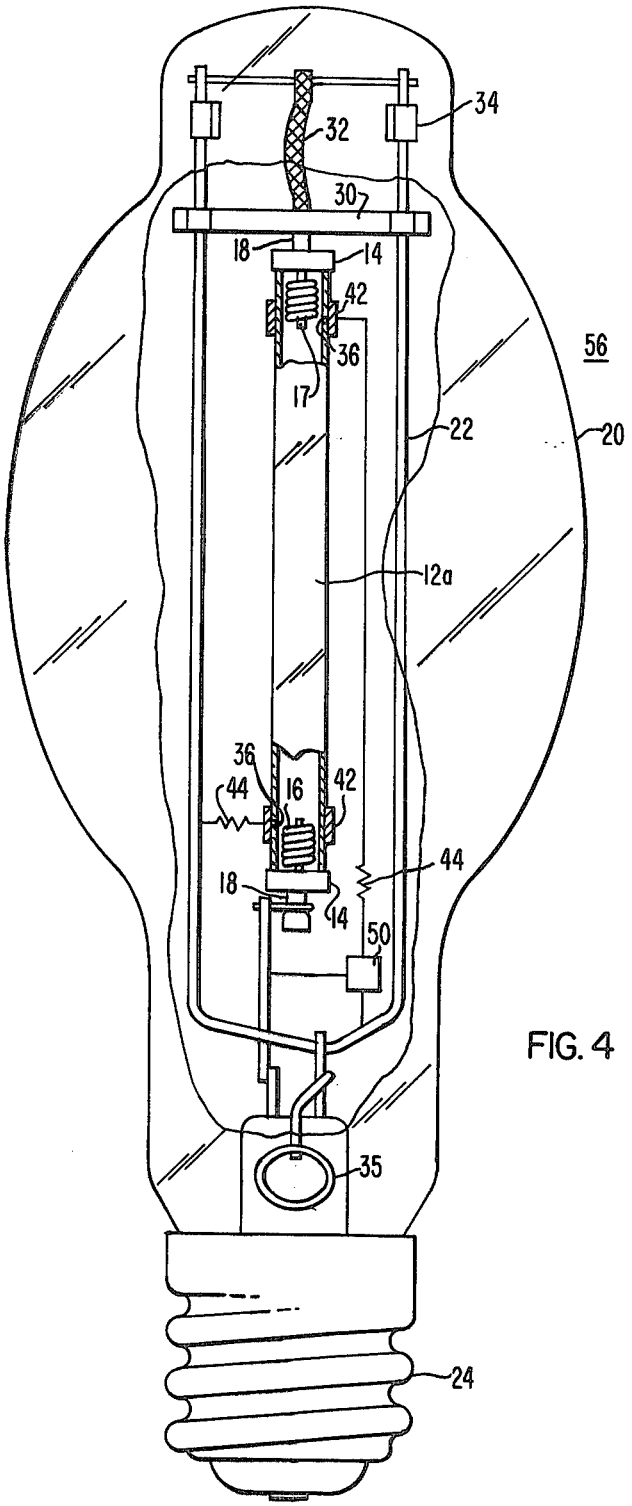
FIG. 4 is an elevational view of a lamp similar to the lamp shown in FIG. 1, but wherein starting aids are provided at both ends of the arc tube and are permanently connected to the power supply for the lamp.

An alternative lamp embodiment 56 is shown in FIG. 4 wherein like numerals refer to like parts as described for the lamp embodiment shown in FIG. 1. This includes the arc tube 12*a*, end cap seals 14, electrodes 16, 17, lead-in conductors 18, outer envelope 20, arc tube supporting frame 22, screw-type base 24, upper support member 30, flexible conductor 32, leaf-spring supports 34, getter support 35, plug-like starting aid means 36, metallic sleeve means 42, starting aid resistor means 44 and insulating supporting member 50. Such a lamp is designed for 400 watts wherein the arc tube 12*a* has a spacing between electrodes of 80 mm, an inner diameter of 8 mm, and a wall thickness of 0.75 mm. The discharge-sustaining filling for such an arc tube comprises 30 mg of sodium or a sodium-mercury amalgam comprising 6.3 mg sodium and 23.7 mg mercury, with an inert ionizable starting gas of xenon at a pressure of 20 torrs. In this embodiment, starting aids 36 are provided at both ends of the arc tube with each starting aid connected through a resistor 44 to the electrode which is positioned at the opposite end of the arc tube. In this embodiment, the starting aids are designed to remain electrically connected at all times, even after the lamp is operating, although they could be isolated from the operating circuit once the lamp is started by means of thermal switches such as described hereinbefore. In the embodiment as shown in FIG. 4, starting is facilitated by the glow discharges which are established at both ends of the lamp. The arc tube embodiment as used in the lamp shown in FIG. 4 is shown in enlarged view in FIG. 5, wherein both ends of the arc tube 12 are provided with plug-type ceramic starting aids 36 proximate both of the operating electrodes 16, 17.

Figure 6:
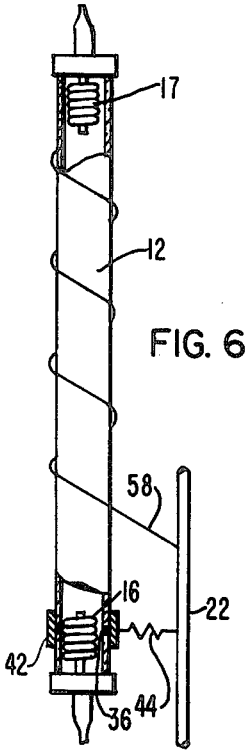
FIG. 6 is an enlarged elevational view, shown partly in section, of an arc tube which is provided with still another starting aid embodiment.

In FIG. 6 is shown yet another arc tube construction wherein a starting aid 36 is provided at one end of the arc tube proximate one of the operating electrodes 16 and a wire helix 58 is wrapped about the arc tube and is directly connected to the frame 22 of the lamp. Once the glow discharge is established between the ceramic plug-type member 36 and the proximate electrode 16, the helical wire 58 which surrounds the arc tube aids in propagating the discharge to the other operating electrode 17, in order to initiate the arc discharge within the lamp. This helical wire starting aid can remain connected in circuit at all times or it can be disconnected from the lamp electrical components once the lamp is operating by means of a thermal switch as described or other suitable switch means. While the starting wire 58 is preferably provided with a helical configuration to facilitate its mounting on the surface of the arc tube 12, any other suitable configuration can be utilized so that the starting-aid wire extends longitudinally along the exterior surface of the arc tube.

The arc tubes having the modified starting aids as described hereinbefore can be mounted in various different types of envelopes with varying type connector means. For example, the arc tube supporting frame need not constitute one of the electrical connection means for connecting the lamp base to the arc tube. Alternatively, the lamp could be double-ended if desired.

I claim:

1. In combination with a high-pressure-discharge sodium lamp comprising an elongated alumina arc tube of predetermined dimensions and having longitudinal walls of predetermined thickness, said elongated arc tube sealed at the ends thereof and enclosing a discharge-sustaining filling comprising sodium and inert ionizable starting gas, electrodes operatively positioned within said arc tube proximate the ends thereof, lead-in means extending through the sealed ends of said arc tube and connecting to said electrodes, a light-transmitting protective outer envelope surrounding said arc tube, frame means positioned within said outer envelope and supporting said arc tube in predetermined position within said outer envelope, electrical adaptor means affixed to said outer envelope for connection to a source of power, a pair of electrical connection means connecting said electrical adaptor means to said lead-in means, and one of said electrical connection means including said frame means to electrically connect one of said electrodes to said electrical adaptor means, the improvement which comprises:

a. at least one small plug-like electrically conductive ceramic means of predetermined dimensions extending through the longitudinal wall of said arc tube proximate at least one of said lamp electrodes, said plug-like ceramic means comprising refractory-oxide-based ceramic matrix which is non-reactive with respect to high-temperature sodium vapor and which possesses the predetermined thermal-physical-chemical properties required to form a high-temperature seal with alumina, and said refractory-oxide-based ceramic matrix fused to the surrounding alumina arc tube wall and having embedded therein a predetermined amount of finely divided refractory metal which is inert with respect to said discharge-sustaining filling to provide said plug-like ceramic means with a predetermined electrical conductivity; and b. during starting of said lamp said plug-like ceramic means electrically connect, exteriorly of said arc tube, to the said electrode which is positioned proximate the opposite end of said arc tube from the connected plug-like ceramic means, and during starting of said lamp the total electrical resistance between the interior surface of said plug-like ceramic means within said arc tube and the connected opposite electrode permitting the maintenance of a glow-type discharge within said arc tube between said interior surface of said plug-like ceramic means and the said electrode which is proximate thereto to ionize the atmosphere within said arc tube.

2. The combination as specified in claim 1, wherein said plug-like ceramic means is connected to said frame means through a starting resistor of predetermined value.

3. The combination as specified in claim 2, wherein said plug-like ceramic means and said starting resistor are permanently connected to said frame means.

4. The combination as specified in claim 2, wherein after said lamp is normally operating, said plug-like ceramic means is electrically isolated from said frame means by a switch means which opens in response to normal lamp operation.

5. The combination as specified in any of claims 2, 3 or 4, wherein a starting assistance conductor directly electrically connects to said frame means and extends longitudinally along the exterior surface of said arc tube.

6. The combination as specified in claim 1, wherein said plug-like ceramic means comprises calcia-alumina-silica matrix having embedded therein finely divided niobium powder.

7. The combination as specified in claim 6, wherein said niobium powder constitutes about 4% by weight of said plug-like ceramic means, and said matrix comprises about 44% to 55% by weight calcia, from about 40% to 50% by weight alumina and from about 0.5% to 10% by weight silica.

8. In combination with a high-pressure-discharge sodium lamp comprising an elongated alumina arc tube of predetermined dimensions and having longitudinal walls of predetermined thickness, said elongated arc tube sealed at the ends thereof and enclosing a discharge-sustaining filling comprising sodium and inert ionizable starting gas, electrodes operatively positioned within said arc tube proximate the ends thereof, lead-in means extending through the sealed ends of said arc tube and connecting to said electrodes, a light-transmitting protective outer envelope surrounding said arc tube, said arc tube supported in predetermined position within said outer envelope, electrical adaptor means affixed to said outer envelope for connection to a source of power, and a pair of electrical connection means connecting said electrical adaptor means to said lead-in means, the improvement which comprises:

a. at least one small plug-like electrically conductive ceramic means of predetermined dimensions extending through the longitudinal wall of said arc tube proximate at least one of said lamp electrodes, said plug-like ceramic means comprising refractory-oxide-based ceramic matrix which is non-reactive with respect to high-temperature sodium vapor and which possesses the predetermined thermal-physical-chemical properties required to form a high-temperature seal with alumina, and said refractory-oxide-based ceramic matrix fused to the surrounding alumina arc tube wall and having embedded therein a predetermined amount of finely divided refractory metal which is inert with respect to said discharge-sustaining filling to provide said plug-like ceramic means with a predetermined electrical conductivity; and b. during starting of said lamp said plug-like ceramic means electrically connect, exteriorly of said arc tube, to the said electrode which is positioned proximate the opposite end of said arc tube from the connected plug-like ceramic means, and during starting of said lamp the total electrical resistance between the interior surface of said plug-like ceramic means within said arc tube and the connected opposite electrode permitting the maintenance of a glow-type discharge within said arc tube between said interior surface of said plug-like ceramic means and the said electrode which is proximate thereto to ionize the atmosphere within said arc tube.

9. An elongated alumina arc tube of predetermined dimensions and having longitudinal walls of predetermined thickness, said elongated arc tube sealed at the ends thereof and enclosing a discharge-sustaining filling comprising sodium and inert ionizable starting gas, electrodes operatively positioned within said arc tube proximate the ends thereof, lead-in means extending through the sealed ends of said arc tube and connecting to said electrodes, small plug-like electrically conductive ceramic means of predetermined dimensions extending through a portion of the longitudinal walls of said arc tube proximate at least one of said electrodes, said plug-like ceramic means comprising refractory-oxide-based ceramic matrix which is non-reactive with respect to high-temperature sodium vapor and which possesses the predetermined thermal-physical-chemical properties required to form a high-temperature seal with alumina, and said refractory-oxide-based ceramic matrix fused to the surrounding alumina arc tube wall and having embedded therein a predetermined amount of finely divided refractory metal which inert with respect to said discharge-sustaining filling to provide said plug-like ceramic means with a predetermined electrical conductivity.

10. The combination as specified in any of claims 1, 8 and 9, wherein metallic sleeve means carried on the exterior surface of said arc tube contacts said plug-like ceramic means to provide electrical connection thereto.

11. The combination as specified in any of claims 1, 8 and 9, wherein metallic sleeve means carried on the exterior surface of said arc tube contacts said plug-like ceramic means to provide electrical connection thereto, and said plug-like ceramic means is bonded to said metallic sleeve means.

* * * * *